United States Patent [19]

Knight et al.

[11] 4,024,826

[45] May 24, 1977

[54] TENSION ATTACHMENT FOR SEWING MACHINES

[75] Inventors: Edward P. Knight, Stokesdale, N.C.; Watson Bailey, Falkrik, Scotland

[73] Assignee: Blue Bell, Inc., Greensboro, N.C.

[22] Filed: Aug. 22, 1975

[21] Appl. No.: 606,757

[52] U.S. Cl. ..... 112/235

[51] Int. Cl.[2] ..... D05B 29/02

[58] Field of Search ..... 112/235, 237, 239, 219 B

[56] References Cited

UNITED STATES PATENTS

| | | | |
|---|---|---|---|
| 2,750,908 | 6/1956 | Odermann et al. | 112/235 X |
| 2,879,733 | 3/1959 | Pierce | 112/235 X |
| 3,298,341 | 1/1967 | Bonis | 112/219 B |
| 3,665,877 | 5/1972 | Wickers et al. | 112/235 |

*Primary Examiner*—H. Hampton Hunter

[57] ABSTRACT

A constant pressure tension attachment for a sewing machine in which fluid means applies a predetermined constant force on a fabric guide means within the limits of fabric guide means displacement.

5 Claims, 8 Drawing Figures

TENSION ATTACHMENT FOR SEWING MACHINES

BACKGROUND, OBJECTIVES AND ADVANTAGES OF THE INVENTION

Industrial and home sewing machines basically employ a spring-loaded presser foot to exert a downward force on a fabric in its directed path of travel through the sewing machine elements during the sewing while the fabric is fed generally by a fabric feeding mechanism which may include serrated feed dogs positioned beneath and extending through a needle plate in cooperation with a presser foot. The presser foot is generally pivotally mounted on the sewing machine with the fabric-receiving forward end being upwardly inclined to facilitate fabric entry at the toe end. Usually increased force is exerted on the fabric being sewn at the heel of the presser foot with the presser foot being suitably hinged or pivoted and spring mounted on a presser foot arm.

Sewing transverse to a seam formed from a plurality of fabric plies in frequently troublesome particularly when relatively heavy denim fabrics and other coarse fabrics are sewn. The spring loaded presser foot assembly is displaced unevenly depending upon the presser foot assembly displacement and the nature of the helical spring modulus. The spring loading on the presser foot may vary depending upon manual adjustment of the spring loading but variations in the force exerted are inevitable and difficult to control across a wide range of fabric thicknesses. Changing or modifying the springs for applying proper force to the presser foot for various fabrics would be time consuming and troublesome.

Accordingly, an objective of this invention is to provide a sewing machine with a presser means that is displaceable between limits with a fluid means that communicates with the presser means for applying a predetermined and constant force to the presser means within the limits of presser means displacement and one that is readily adjustable depending upon the seam thickness in the fabric being sewn.

Another objective of this invention is to provide a sewing machine which incorporates a presser foot with a fluid actuated means for applying a predetermined and constant force to the presser foot which force may be readily adjusted.

Still another objective of this invention is the provision of a pneumatically-operated piston connected to a fabric presser means on a sewing machine for applying a predetermined and substantially constant force to the presser means that is displaceable between limits without incurring substantially increased forces throughout the displacement of the presser means during sewing across seams that are substantially bulky.

Other objectives and many of the attendant advantages of this invention will become more readily apparent to those skilled in the sewing machine art to which this invention is applicable including its use in conjunction with various types of fabric guide and control mechanisms when considered in conjunction with the accompanying drawing and detailed description of two preferred embodiments of the invention which are described without intending any limitations for their use in conjunction with other operating mechanisms connected directly or indirectly to foot treadles or other sewing machine actuating and deactivating mechanisms.

DETAILED DESCRIPTION OF PREFERRED EMBODIMENTS OF THIS INVENTION

Figure 1:
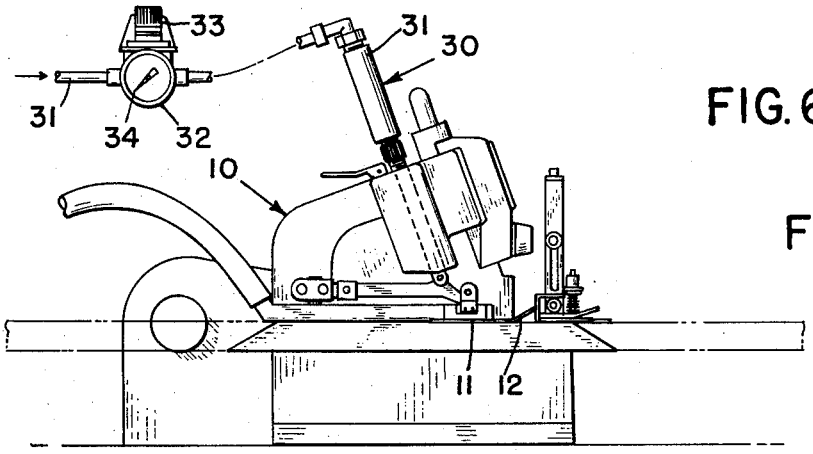
FIG. 1 is a side elevational view of a sewing machine with a presser foot and fluid means to exert a predetermined force on the presser foot arm embodying this invention.

Referring to the drawing and particularly to FIG. 1, there is illustrated a conventional sewing machine 10 which may be a Willcox & Gibbs 500/IV or similar make of another manufacturer that is provided with conventional sewing elements and a work plate 11 positioned beneath the presser foot 12 for guidably retaining a fabric being sewn in a directed path of travel. Conventional fabric feeding mechanisms (not shown) are employed to urge a fabric in its directed path of travel to the sewing elements by means of conventional feed dogs (not shown) or other means including those sewing machines that employ a top feed puller and short presser foot for sewing seams or hems in various types of fabrics of various thicknesses. The work plate is provided with a conventional needle plate (not shown) through which the feed dogs pass to engage the fabric to urge the fabric to pass in a directed path of travel from the feeding position in front of the sewing machine through the sewing machine.

Figure 4:
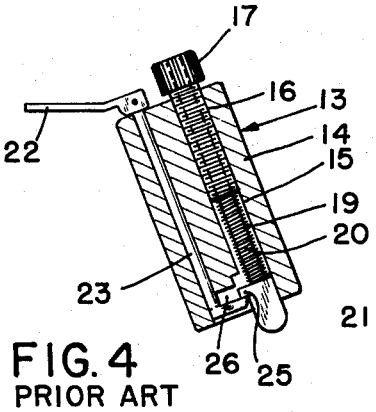
FIG. 4 PRIOR ART
FIG. 4 is a side elevational and sectional view of a conventional adjustable presser foot spring-loading assembly for a sewing machine omitting the presser foot.

It is presently conventional for the presser foot to be spring-loaded and urged downwardly against the fabric and needle plate employing the mechanism 13 shown in FIG. 4 which exemplifies the prior art. The housing 14 is mounted on a sewing machine and is provided with an axial cylindrical bore 15, one end 16 of which is threaded to threadably receive the presser spring regulating thumb screw 17. The end 18 of the thumb screw 17 engages the displaceable presser spring plunger 19 about which the helical spring 20 is retained with the extending presser arm connecting end 21 of the plunger 23 being releasably secured to an intermediate portion of a presser foot arm. A cammed handlift lever 22 is pivotally connected to the handlift lever plunger 23 at the terminal end of which is a projecting lug 24 for engaging the mating lug 25 that extends from the presser arm connecting end 21 of the plunger 23. Upon elevating the handlift lever 22, the lugs 24 and 25 will be engaged to urge the plunger 19 upwardly to raise the presser foot assembly against the downward force exerted by spring 20. In normal operation the spring 20 will exert a varying force on the presser foot assembly depending upon the vertical displacement of the presser foot caused by the thickness of the fabrics and fabric seams being sewn. Problems are encountered by this uneven or non-uniform force exerted which varies with the types of springs employed and the spring modulus. Substituting one spring for another depending upon the nature of the sewing operation is time consuming and most operators are not able to make such changes in industrial operations.

Figure 2:
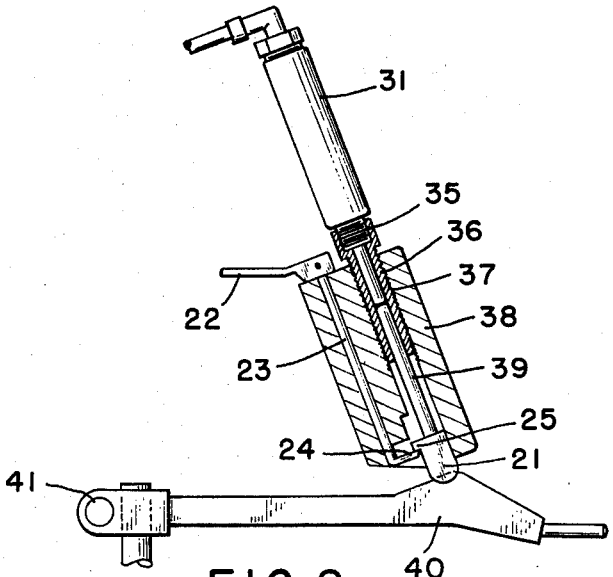
FIG. 2 is an enlarged partial side elevational and partial longitudinal sectional view of the fluid means of FIG. 1 connected to a presser foot.
Figure 3:
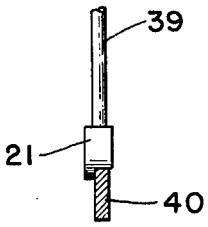
FIG. 3 is a partial side elevational and sectional view of the presser foot arm and fluid-actuated piston of FIG. 2 omitting the cylinder housing.

It has been found advantageous to provide a constant and predetermined force on the presser means which is displaceable between limits and throughout such limits by utilizing fluid control means 30 as shown in FIGS. 1 and 2. Preferably, air under pressure is supplied to the inlet line 31 and the desirable pressure is adjusted by the manually adjustable pressure relief valve 32 which may be a standard regulator valve with graduated dial gauge face such as manufactured by Schrader, No. 5421 AR. A pressure adjusting knob 33 is provided to regulate the pressure which is shown on the face 34 of the dial. Air under pressure is admitted to the accumulator chamber 31 which is threadably connected to the fitting 35 which in turn is threadably connected with the threads 36 in the cylinder 37 of the housing 38 for the retaining the displaceable plunger 39. The plunger 39 acts as a piston that is axially displaceable between limits in the cylinder 37 and is provided with the same type of presser foot engaging-member 21 as shown and described in the prior art unit shown in FIG. 4.

Also, the hand lift lever 22 and its plunger 23 with projecting lug 24 are similar to that shown in the prior art unit of FIG. 4 and acts in the same manner. The presser foot arm 40 is shown connected to the lower end of the plunger-piston 39 at the terminal end 21 thereof. The presser foot arm is pivotally connected to the housing of the sewing machine through a suitable linkage in the conventional manner at the terminal end 41 of the presser foot arm.

In operation, the constant pressure tension attachment may be regulated by the operator adjusting the knob 33 on the pressure relief valve 32 to the appropriate pressure level to exert the desired predetermined and constant force on the presser foot within the limits of presser foot displacement. Suitable adjustments to the fluid pressure may be exerted on the piston 39 by regulating the fluid pressure admitted to the cylinder 37 from the regulating valve 32 by adjusting the knob 33.

Figure 6:
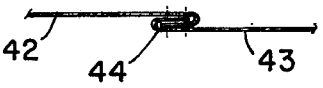
FIG. 6 is a transverse sectional view of one type of felled seam across which this invention has been applied.
Figure 8:
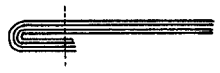
FIG. 8 is a partial sectional view taken along line 7—7 of FIG. 7 showing eight thicknesses of fabric in which this invention has been successfully employed.
Figure 7:
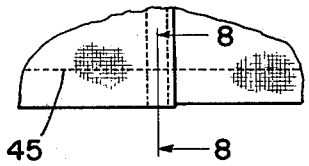
FIG. 7 is a partial plan view of a portion of a sewn fabric having a felled seam of FIG. 7 and a transverse hem across the felled seam.

There is illustrated in FIGS. 6 through 8 fabrics 42 and 43 that are seamed together by a felled seam 44 in which there are four plies or thicknesses of fabric at the seam across which the transverse seam 45 must be formed as shown in FIG. 8. By utilizing the fluid means for controlling the displacement of the presser foot of this invention, through the limits of presser foot displacement, a predetermined and substantially constant force is exerted on the presser foot substantially minimizing force variations on the presser foot assembly which occur in the use of the helical or other spring means of the prior art. As shown in FIGS. 7 and 8, as many as eight plies of fabric are sewn which must be accomodated on the same machine as when only two plies may be sewn. The wide divergence is more readily accepted by the fluid means as opposed to the use of springs.

Figure 5:
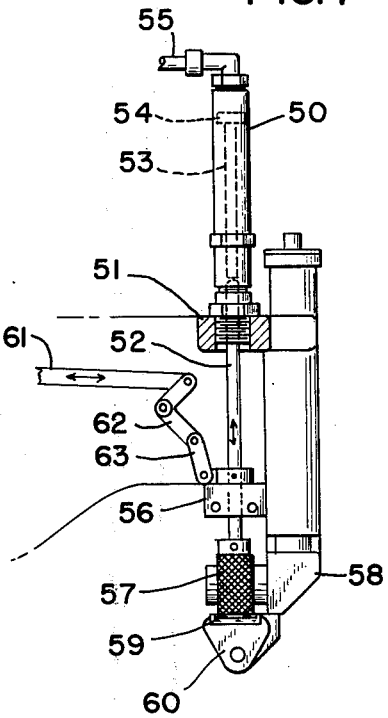
FIG. 5 is a side elevational view of a modified embodiment of this invention in conjunction with a fabric roller puller guide and presser assembly for use in conjunction with another type of sewing machine.

A modified embodiment of the invention is shown in FIG. 5 in conjunction with a top feed puller sewing machine. The cylinder 50 is mounted above the housing bracket 51 on the sewing machine directly in line with the presser plunger 52 which is articulated with the piston rod 53. The piston rod 53 is connected to the piston 54 that is displaceable within the cylinder 50 into which air or other suitable fluid is introduced through the inlet line 55 after a pressure regulating valve 32 of the type shown in FIG. 1, or other suitable pressure relief means is used.

Plunger 52 is guidably retained by the sleeve bracket 56, and at the end of the plunger 52 is a knurled roller 57 that is rotatably mounted through suitable bearings and driven by conventional gearing means (not shown) within the housing 58. Fabric to be sewn is positioned beneath roller 57 on the workplate 59 positioned above the work rest support member 60.

In operation, the roller 57 is urged downwardly against a fabric to be drawn through the sewing instrumentalities (not shown) at a predetermined and constant force that is exerted on the presser roller 57 within the limits of presser roller displacement. The lever 61 is connected to the pivotable bell crank 62 which in turn is connected to the connecting link 63 that engages the bracket 56 for the purpose of elevating or lowering the roller 57 independently of the fluid-actuated piston 54.

It will be readily apparent that the constant pressure tension attachment may be readily employed with existing sewing machines with but minor modifications and incorporated on new machines by preferably eliminating completely the presser foot spring tension means and manual regulating screw by incorporating suitable fittings to conduct suitable fluid means, whether air or oil, to the cylinder and piston through an appropriate pressure regulating valve to achieve a substantially uniform force applied to the presser assembly throughout its displacement limits during sewing operations of various seam thicknesses.

We claim:

1. A constant pressure tension attachment for a sewing machine having a fabric guide comprising; means on said sewing machine for guidably urging fabric along a direct path of travel, presser means displaceable between limits for exerting a force on the fabric as it travels along a directed path of travel, fluid means directly communicating with said presser means for applying the limits of presser means displacement, said fluid means including an accumulator for said fluid means mounted on said sewing machine above said presser means.

2. A constant pressure tension attachment for a sewing machine fabric guide as claimed in claim 1, said presser means including a presser foot, said presser foot having a pivotable supporting arm, said arm being connected at one end thereof to said sewing machine.

3. A constant pressure tension attachment for a sewing machine fabric guide as claimed in claim 1, said fluid means having a housing, said housing having a cylinder, a piston movable between limits within said cylinder, said piston having one end projecting from said cylinder, said piston end being connected to said pressure means, and means for controlling fluid pressure in said cylinder.

4. A constant pressure tension attachment for a sewing machine fabric guide as claimed in claim 1, and means for raising said presser means against the force of said fluid means.

5. A constant pressure tension attachment for a sewing machine fabric guide as claimed in claim 1, said presser means including a pressure foot, said pressure foot having a pivotable supporting arm, said arm being connected to said sewing machine, said fluid means having a housing, means for controlling fluid pressure to said housing, said housing having a cylinder, a piston displaceable within said cylinder between limits, said piston having one end projecting from said cylinder, said piston end being connected to said presser foot whereby a predetermined and substantially constant force is exerted by said fluid means between the limits of presser foot displacement.

* * * * *